US010476200B1

(12) United States Patent
Worsham

(10) Patent No.: US 10,476,200 B1
(45) Date of Patent: Nov. 12, 2019

(54) SCREW-ON FEMALE CONNECTOR FOR A MULTI-PIN SWITCH

(71) Applicant: David Worsham, Santa Rosa Beach, FL (US)

(72) Inventor: David Worsham, Santa Rosa Beach, FL (US)

( * ) Notice: Subject to any disclaimer, the term of this patent is extended or adjusted under 35 U.S.C. 154(b) by 0 days.

(21) Appl. No.: 15/971,886

(22) Filed: May 4, 2018

(51) Int. Cl.
*H01R 4/38* (2006.01)
*H01R 13/52* (2006.01)
*H01R 13/622* (2006.01)
*H01R 13/70* (2006.01)

(52) U.S. Cl.
CPC ..... *H01R 13/5219* (2013.01); *H01R 13/5202* (2013.01); *H01R 13/622* (2013.01); *H01R 13/701* (2013.01)

(58) Field of Classification Search
CPC ..... H01R 13/622; H01R 2103/00; H01R 13/62933; F21S 6/002
USPC ..... 439/320, 322, 323, 372
See application file for complete search history.

(56) References Cited

U.S. PATENT DOCUMENTS 2,563,712 A * 8/1951 Frei ..... H01R 13/621 439/279
3,271,725 A * 9/1966 Bloch ..... H01R 13/453 439/141
3,850,495 A * 11/1974 Glover ..... H01R 13/53 439/273
4,203,640 A * 5/1980 Bice ..... H01R 13/4532 439/139
4,296,986 A * 10/1981 Herrmann, Jr. ..... H01R 13/53 439/322
4,673,234 A * 6/1987 Lewis ..... H01R 13/565 439/323
4,808,127 A * 2/1989 Swanic ..... H01R 13/623 439/139
5,376,015 A * 12/1994 Fuchs ..... H01H 1/5866 285/92
6,994,579 B2 * 2/2006 Yokoigawa ..... H01R 13/622 439/311
7,874,860 B2 * 1/2011 Starke ..... H01R 13/622 439/216
8,241,068 B2 * 8/2012 Millard ..... H01R 13/6461 439/320
8,585,424 B2 * 11/2013 Montena ..... H01R 12/70 439/320

(Continued)

*Primary Examiner* — Thanh Tam T Le
(74) *Attorney, Agent, or Firm* — Lanier Ford Shaver & Payne PC; Gerald M. Walsh

(57) ABSTRACT

A screw-on female connector for a multi-pin switch having a housing with a retaining flange around the front end of the housing. A screw-on nut is mounted rotatably on the front end of the housing and the retaining flange retains the screw-on nut at the front end of the housing while allowing it to be screwed onto the mounting threads of a male switch. The screw-on female connector has a front seal positioned in an interior of the housing near the front end of the housing. The front seal is constructed to form a water tight connection between the screw-on female connector and a male connector when the screw-on nut is tightened onto the male connector. The screw-on nut also prevents the two connectors from being pulled apart. A rear seal at a rear end of the housing, in combination with the front seal, completely seals the screw-on female connector.

11 Claims, 4 Drawing Sheets

(56) References Cited

U.S. PATENT DOCUMENTS 8,591,268 B2 * 11/2013 Reimchen ..... H01R 9/03
439/689

* cited by examiner

SCREW-ON FEMALE CONNECTOR FOR A MULTI-PIN SWITCH

FIELD OF THE INVENTION

This invention relates to female connectors for multi-pin switches and, more particularly, to a screw-on female connector for a multi-pin switch.

BACKGROUND OF THE INVENTION

Female connectors for multi-pin switches, such as anti-vandal switches are pushed on to a male connector to form a connection. FIGS. 1*a* and 1*b* show a typical anti-vandal switch unconnected (FIG. 1*a*) and connected (FIG. 1*b*).

In FIG. 1*a* the male connector 10 and the female connector 16 are not connected. The male connector 10 has a front end 11, a rear end 12, a push button switch 13, electrical connecting pins 14, a locking tab 15 and mounting threads 21. The female connector 16 has a front end 17, a rear end 18, a locking hook 19 and electrical wires 20. In FIG. 1*b*, the male connector 10 and the female connector 16 are pressed together to make a connection and the locking hook 19 engages the locking tab 15. A drawback of the locking hook 19 and locking tab 15 arrangement is that the male connector 10 and female connector 16 are not tightened together and a water-tight connection is not established. In addition, the locking hook 19 and the locking tab 15 can often be easily pulled apart.

SUMMARY OF THE INVENTION

The present invention is a screw-on female connector for a multi-pin switch having a housing, with a front end, a rear end, an interior, a retaining flange around the front end of the housing and a screw-on nut mounted rotatably on the front end of said housing. The retaining flange retains the screw-on nut at the front end of the housing while allowing it to be screwed onto the mounting threads of a male switch.

The screw-on nut has a front end, a rear end, and an interior. Raised threads are positioned in the interior of the screw-on nut near the front end of the screw-on nut and stop members are positioned in the interior of the screw-on nut near the rear end of the screw-on nut. The raised threads and the stop members define a retaining area between them. The raised threads are constructed to engage threads of a male connector. The screw-on nut is constructed to screw on to the male connector and to tighten the female connector against the male connector.

The retaining flange is retained in the retaining area by the raised threads and the stop members. A front seal having female electrical connections embedded therein is positioned in the interior of the housing near the front end of the housing. The front seal is constructed to form a water tight connection between the female connector and the male connector. A rear seal is positioned in the interior of the housing near the rear end of the housing.

An advantage of the screw-on female connector of the present invention is that it can be easily attached to the mounting threads of a standard male connector.

Another advantage is that the screw-on nut can tighten the female connector to the male connector sufficiently to produce a water tight and water resistant connection between the two connectors.

Another advantage is that the screw-on nut prevents the two connectors from being pulled apart.

Another advantage is that the front seal and the rear seal provide a water tight and water resistant screw-on female connector.

DETAILED DESCRIPTION OF THE INVENTION

While the following description details the preferred embodiments of the present invention, it is to be understood that the invention is not limited in its application to the details of the accompanying figures, since the invention is capable of other embodiments and of being practiced in various ways.

Figure 1A:
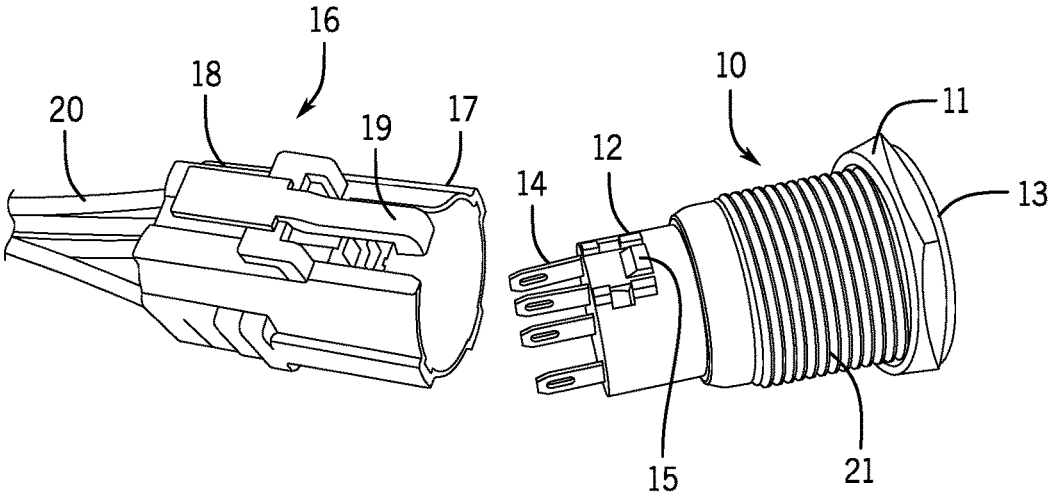
FIG. 1a PRIOR ART
FIG. 1*a* shows a typical multi-pin anti-vandal switch in an unconnected configuration.
Figure 1B:
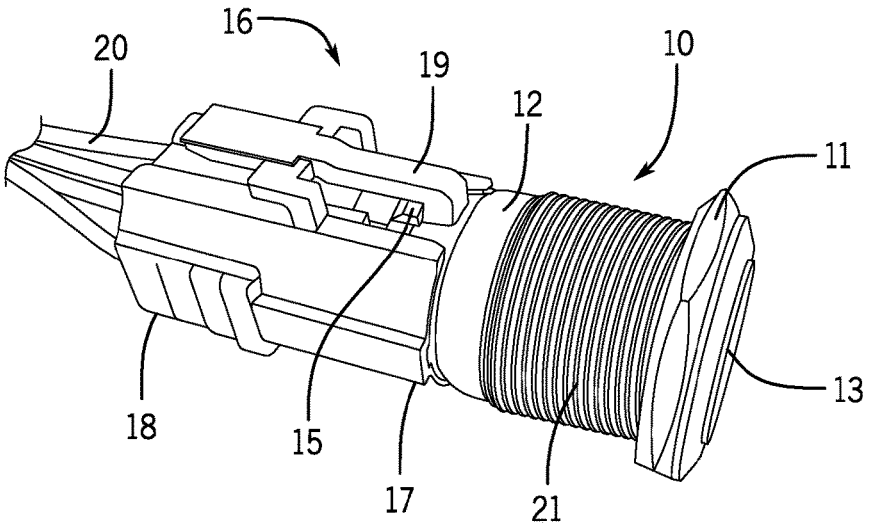
FIG. 1b PRIOR ART
FIG. 1*b* shows a typical multi-pin anti-vandal switch in a connected configuration.
Figure 2:
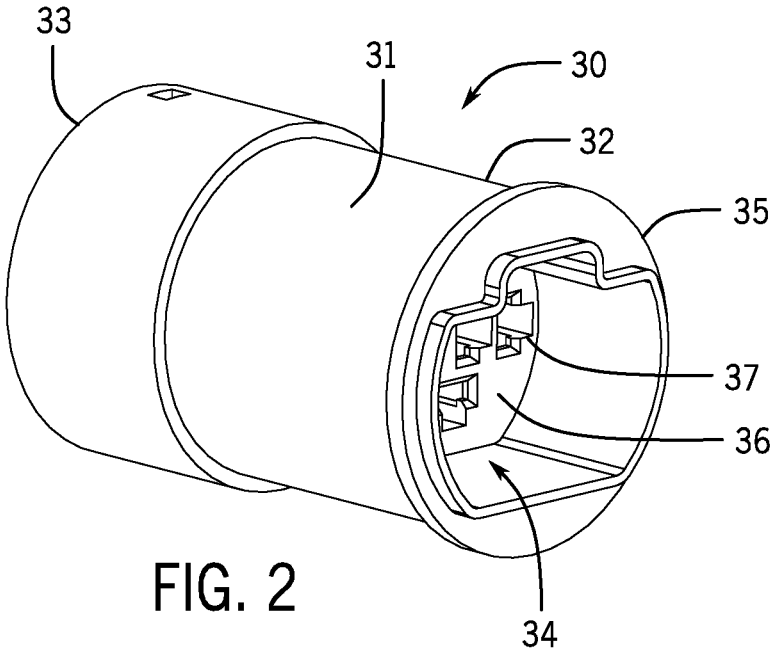
FIG. 2 shows a side, front perspective view of the screw-on female connector of the present invention.
Figure 3:
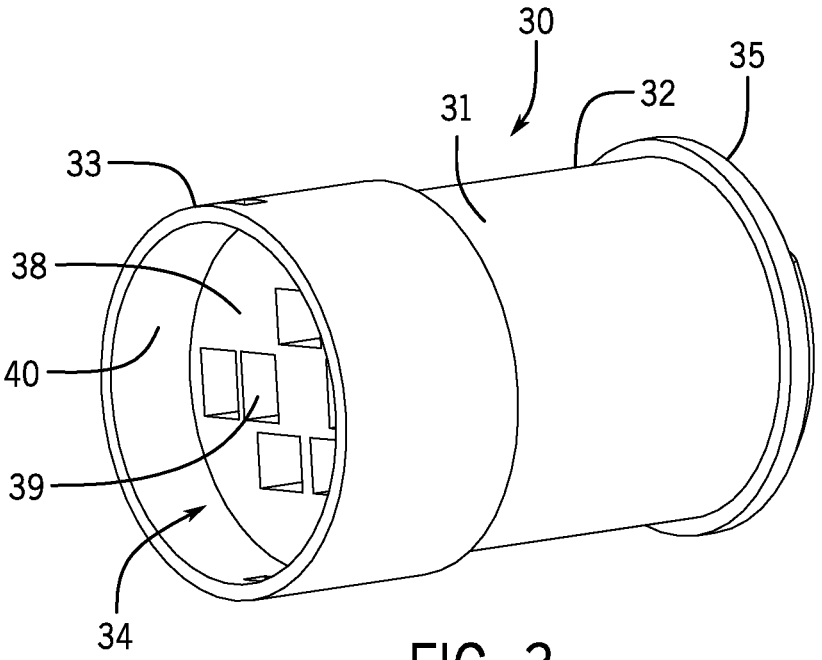
FIG. 3 shows a side, rear perspective view of the screw-on female connector.

FIG. 2 shows a side, front perspective view of the screw-on female connector 30 of the present invention. The screw-on female connector 30 has housing 31 with a front end 32, a rear end 33 and an interior 34. A retaining flange 35 is positioned around the front end 32. A front seal 36 having female electrical connections 37 embedded therein is positioned in the interior 34 near the front end 32. FIG. 3 is a side, rear perspective view of the screw-on female connector 30. FIG. 3 further shows an electrical wire guide 38 with channels 39 for electrical wires. A rear seal chamber 40 is formed at the rear end 33.

Figure 5:
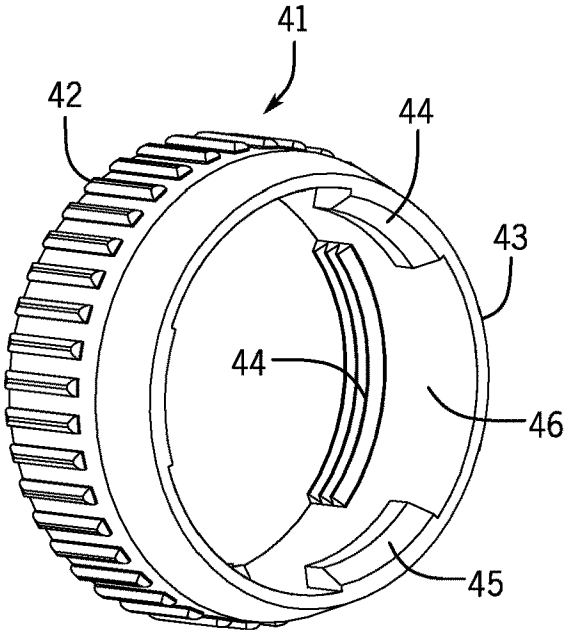
FIG. 5 shows a rear perspective view of the screw-on nut.
Figure 4:
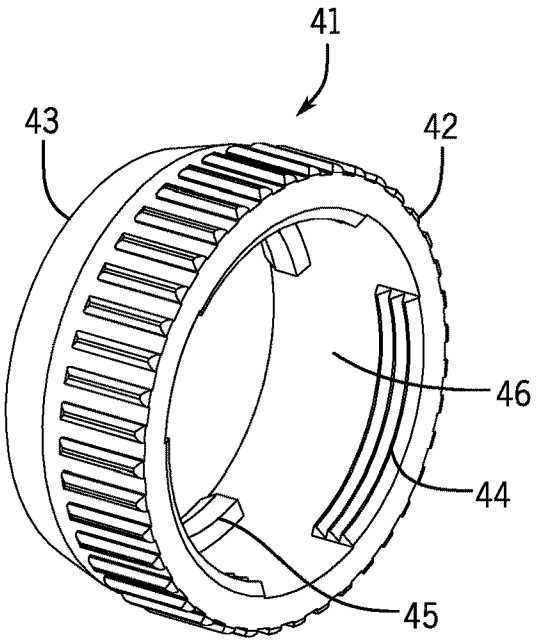
FIG. 4 shows a front perspective view of a screw-on nut for connecting the screw-on female connector to a male connector.
Figure 7:
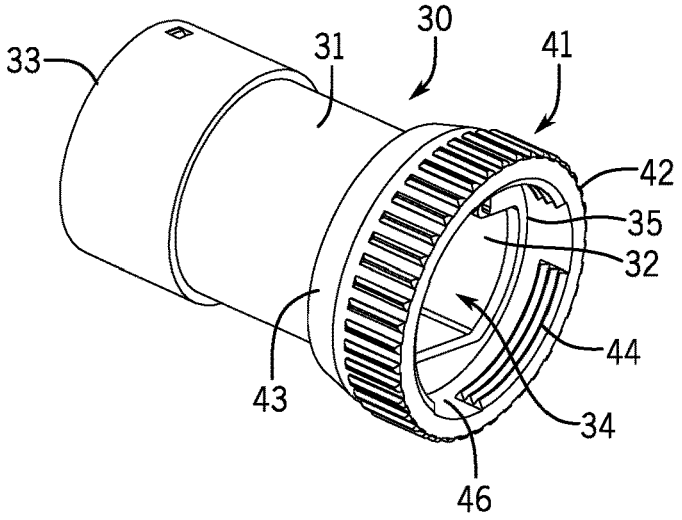
FIG. 7 shows a front perspective view of the screw-on nut mounted rotatably to the front end of the housing.
Figure 8:
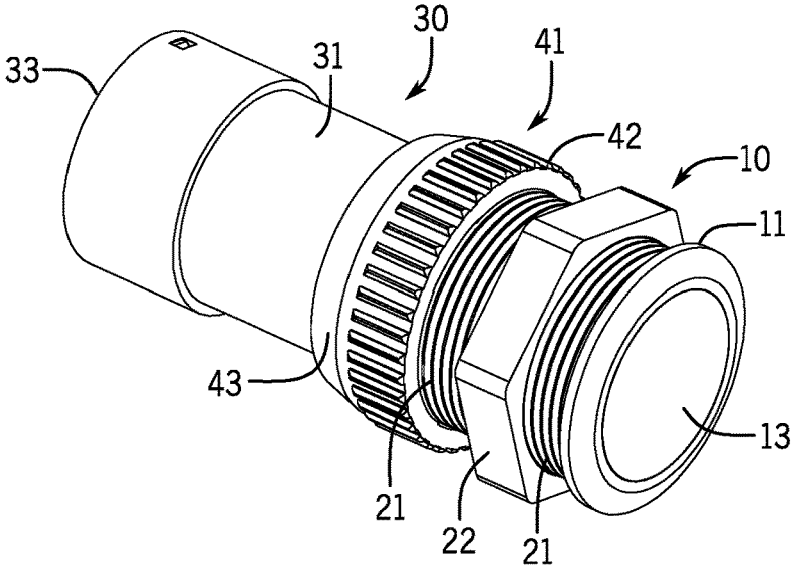
FIG. 8 shows a front perspective view of a male connector attached, by means of the screw-on nut, to the screw-on female connector.
Figure 9:
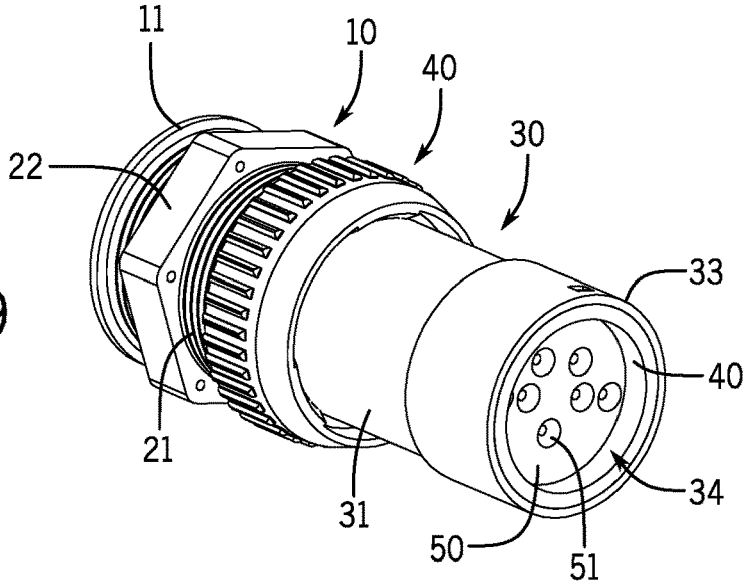
FIG. 9 shows a rear perspective view of a male connector attached, by means of the screw-on nut, to the screw-on female connector.

FIG. 4 shows a front perspective view of a screw-on nut 41 which is positioned rotatably on the front end 32 of the housing 31 (see FIGS. 7, 8, and 9). Screw-on nut 41 has a front end 42, a rear end 43, raised threads 44, stop members 45 and a retaining area 46. FIG. 5 shows a rear perspective view of the screw-on nut 41. The retaining flange 35 fits in the retaining area 46 and is retained there by the raised threads 44 and stop members 45.

Figure 6:
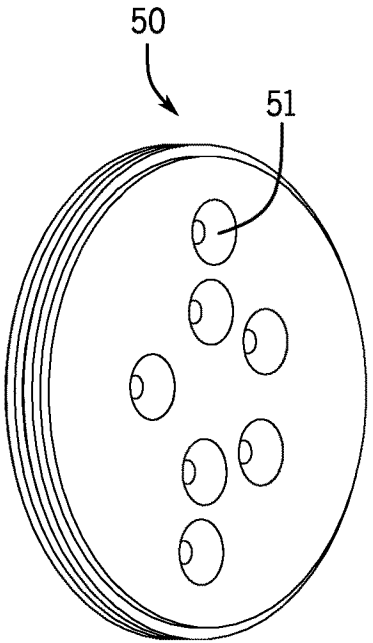
FIG. 6 shows a rear seal for a rear end of the housing.

FIG. 6 shows a rear seal 50 having holes 51 for electrical wires to pass through. The rear seal 50 fits in the rear seal chamber 40.

FIG. 7 shows a front perspective view of the screw-on nut 41 mounted rotatably to the front end 32 of the housing 31. The retaining flange 35 is positioned in the retaining area 46 between the raised threads 44 and the stop members 45. In this configuration the screw-on nut 41 rotates freely but remains in place at the front end 32 of the housing 31.

FIG. 8 shows a front perspective view of a male connector 10 attached to the screw-on female connector 30 by means of the screw-on nut 41. The screw-on nut 41 is threaded onto threads 21 of the male connector 10 by means of raised threads 44. A mounting nut 22 is also shown threaded onto the male connector 10. As the screw-on nut 41 is screwed onto the threads 21 of the male connector 10, the front seal 36 is tightened against the male connector 16 to provide a watertight, water resistant connection between the female connector 30 and the male connector 10.

FIG. 9 shows a rear perspective view of a male connector 10 attached to the screw-on female connector 30 by means of the screw-on nut 41. The rear seal 50 is shown positioned in the rear seal chamber 40 at the rear end 33 of the housing 31. The rear seal 50 in combination with the front seal 36 renders the entire screw-on female connector 30 watertight and water resistant.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the screw-on female connector can be made of any suitable plastic or metal or a combination thereof. The screw-on female connector can be made in any size and for any type of male connector and can be constructed as a single pin connector. The screw-on nut feature can be adapted to male connectors to form screw-on male connectors.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A male multipin switch having a screw-on female connector, comprising:

a) a multipin switch having a front end, a rear end, a push button switch at the front end, male electrical connecting pins at the rear end, and mounting threads;

b) a screw-on female connector connecting threadably to the male multipin switch, the screw-on female connector comprising:

1) a housing having a front end, a rear end, and an interior;

2) a retaining flange around said front end of said housing;

3) a screw-on nut mounted rotatably on said housing, the screw-on nut having a front end, a rear end, and an interior;

4) raised threads positioned in the interior of the screw-on nut near the front end of the screw-on nut and stop members positioned in the interior of the screw-on nut near the rear end of the screw-on nut, wherein the raised threads threadably engage threads on said multi-pin switch and connect the screw-on female connector to said multi-pin switch; and 5) the retaining flange being positioned in a retaining area between the raised threads and the stop members of the screw-on nut, wherein the raised threads near the front end of the screw-on nut engage a surface of the retaining flange at the front end of the screw-on nut and the raised threads that engage the surface of the retaining flange also threadably engage the mounting threads of said multi-pin switch so as to pull said multi-pin switch into the interior of the housing as the screw-on nut is rotated on threads of said multi-pin switch, said surface of the retaining flange facing the front end of the screw-on nut.

2. The male multipin switch of claim 1, further comprising said raised threads that engage said surface of the retaining flange tighten said screw-on female connector against said multi-pin switch as the screw-on nut is rotated on threads of said multi-pin switch.

3. The male multipin switch of claim 1, further comprising female electrical connections embedded in a front seal positioned in said interior of said housing of said screw-on female connector near said front end of said housing, said female electrical connections connecting to male electrical connecting pins in said multi-pin switch.

4. The male multipin switch of claim 3, further comprising said front seal forming a water tight connection between said screw-on female connector and said multi-pin switch.

5. The male multipin switch of claim 1, further comprising a rear seal in said interior of said housing of said screw-on female connector near said rear end of said housing.

6. A male multipin switch having a screw-on female connector, comprising:

a) a multipin switch having a front end, a rear end, a push button switch at the front end, male electrical connecting pins at the rear end, and mounting threads;

b) a screw-on female connector connecting to the male multipin switch, the screw-on female connector comprising:

1) a housing having a front end, a rear end, and an interior;

2) a retaining flange around said front end of said housing;

3) a screw-on nut mounted rotatably on said housing, the screw-on nut having a front end, a rear end, and an interior;

4) raised threads positioned in the interior of the screw-on nut near the front end of the screw-on nut and stop members positioned in the interior of the screw-on nut near the rear end of the screw-on nut, wherein the raised threads threadably engage threads on said multi-pin switch and connect the screw-on female connector to said multi-pin switch;

5) the retaining flange being positioned in a retaining area between the raised threads and the stop members of the screw-on nut, wherein the raised threads near the front end of the screw-on nut engage a surface of the retaining flange at the front end of the screw-on nut and the raised threads that engage the surface of the retaining flange also threadably engage the mounting threads of said multi-pin switch so as to pull said multi-pin switch into the interior of the housing as the screw-on nut is rotated on threads of said multi-pin switch, said surface of the retaining flange facing the front end of the screw-on nut; and 6) said raised threads that engage said surface of the retaining flange tighten said screw-on female connector against said multi-pin switch as the screw-on nut is rotated on threads of said multi-pin switch.

7. The male multipin switch of claim 6, further comprising female electrical connections embedded in a front seal and positioned in said interior of said housing near said front end of said housing, said female electrical connections connecting to male electrical connecting pins in said multi-pin switch.

8. The male multipin switch of claim 7, further comprising said front seal forming a water tight connection between said screw-on female connector and said multi-pin switch.

9. The male multipin switch of claim 6, further comprising a rear seal in said interior of said housing near said rear end of said housing.

10. A male multipin switch having a screw-on female connector, comprising:

a) a multipin switch having a front end, a rear end, a push button switch at the front end, male electrical connecting pins at the rear end, and mounting threads;

b) a screw-on female connector connecting to the male multipin switch, the screw-on female connector comprising:

1) a housing having a front end, a rear end, and an interior;

2) a retaining flange around said front end of said housing;

3) a screw-on nut mounted rotatably on said housing, the screw-on nut having a front end, a rear end, and an interior;

4) raised threads positioned in the interior of the screw-on nut near the front end of the screw-on nut and stop members positioned in the interior of the screw-on nut near the rear end of the screw-on nut, wherein the raised threads threadably engage threads on said multi-pin switch and connect the screw-on female connector to said multi-pin switch;

5) the retaining flange being positioned in a retaining area between the raised threads and the stop members of the screw-on nut, wherein the raised threads near the front end of the screw-on nut engage a surface of the retaining flange at the front end of the screw-on nut and the raised threads that engage the surface of the retaining flange also threadably engage the mounting threads of said multi-pin switch so as to pull said multi-pin switch into the interior of the housing as the screw-on nut is rotated on threads of said multi-pin switch, said surface of the retaining flange facing the front end of the screw-on nut;

6) said raised threads that engage said surface of the retaining flange tighten said screw-on female connector against said multi-pin switch as the screw-on nut is rotated on threads of said multi-pin switch; and (7) female electrical connections embedded in a front seal positioned in said interior of said housing of said screw-on female connector near said front end of said housing, said female electrical connections connecting to male electrical connecting pins in said multi-pin switch, and said front seal form a water tight connection between said screw-on female connector and said multi-pin switch.

11. The male multipin switch of claim 10, further comprising a rear seal in said interior of said housing of said screw-on female connector near said rear end of said housing.

* * * * *